US009901836B1

(12) United States Patent
Moreland et al.

(10) Patent No.: US 9,901,836 B1
(45) Date of Patent: Feb. 27, 2018

(54) INFLATABLE WATER SLIDE ASSEMBLY

(71) Applicants: John Moreland, Dublin, CA (US); Thomas Freeman, Sun City, CA (US)

(72) Inventors: John Moreland, Dublin, CA (US); Thomas Freeman, Sun City, CA (US)

( * ) Notice: Subject to any disclaimer, the term of this patent is extended or adjusted under 35 U.S.C. 154(b) by 0 days.

(21) Appl. No.: 15/425,797

(22) Filed: Feb. 6, 2017

(51) Int. Cl.

| | |
|---|---|
| ***A63G 21/18*** | (2006.01) |
| ***A63G 31/00*** | (2006.01) |
| ***B05B 9/04*** | (2006.01) |
| ***B05B 15/06*** | (2006.01) |

(52) U.S. Cl.
CPC ..... *A63G 21/18* (2013.01); *A63G 31/007* (2013.01); *B05B 9/0423* (2013.01); *B05B 15/061* (2013.01)

(58) Field of Classification Search
CPC ..... A63G 21/00; A63G 21/18; A63G 31/00; A63G 31/12
USPC ..... 472/116, 117, 128
See application file for complete search history.

(56) References Cited

U.S. PATENT DOCUMENTS

| | | | | |
|---|---|---|---|---|
| 5,154,671 | A | 10/1992 | Smollar et al. | |
| 5,401,214 | A | 3/1995 | Smollar et al. | |
| 6,062,983 | A * | 5/2000 | Butsook | A63G 21/18 4/488 |
| 6,406,377 | B1 | 6/2002 | Demko | |
| 6,648,767 | B1 | 11/2003 | Chen | |
| 7,431,654 | B2 * | 10/2008 | Ochi | A63G 21/00 446/167 |
| D597,624 | S | 8/2009 | Boulton et al. | |
| 7,927,175 | B2 * | 4/2011 | Coffey | F41B 9/0021 222/79 |
| 7,967,692 | B2 | 6/2011 | Werner | |
| 2005/0181882 | A1 | 8/2005 | Sanchez | |
| 2007/0167246 | A1 | 7/2007 | McKee et al. | |
| 2010/0285893 | A1 | 11/2010 | Leimone et al. | |

* cited by examiner

*Primary Examiner* — Kien Nguyen

(57) ABSTRACT

A inflatable water slide assembly includes a slide that may be positioned on a support surface thereby facilitating the slide to be slid upon. A bladder is coupled to the slide. A lighting unit is coupled to the slide to selectively illuminate the slide. A spraying unit is coupled to the slide and the spraying unit is selectively fluidly coupled to a fluid source thereby facilitating the slide to be filled with a fluid. The bladder retains the fluid on the slide. The spraying unit continuously recycles the fluid to spray the fluid onto the slide without being fluidly connected to the fluid source.

11 Claims, 4 Drawing Sheets

INFLATABLE WATER SLIDE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to water slide devices and more particularly pertains to a new water slide device for continuously recycling water for sliding on the water slide.

BRIEF SUMMARY OF THE INVENTION

An embodiment of the disclosure meets the needs presented above by generally comprising a slide that may be positioned on a support surface thereby facilitating the slide to be slid upon. A bladder is coupled to the slide. A lighting unit is coupled to the slide to selectively illuminate the slide. A spraying unit is coupled to the slide and the spraying unit is selectively fluidly coupled to a fluid source thereby facilitating the slide to be filled with a fluid. The bladder retains the fluid on the slide. The spraying unit continuously recycles the fluid to spray the fluid onto the slide without being fluidly connected to the fluid source.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
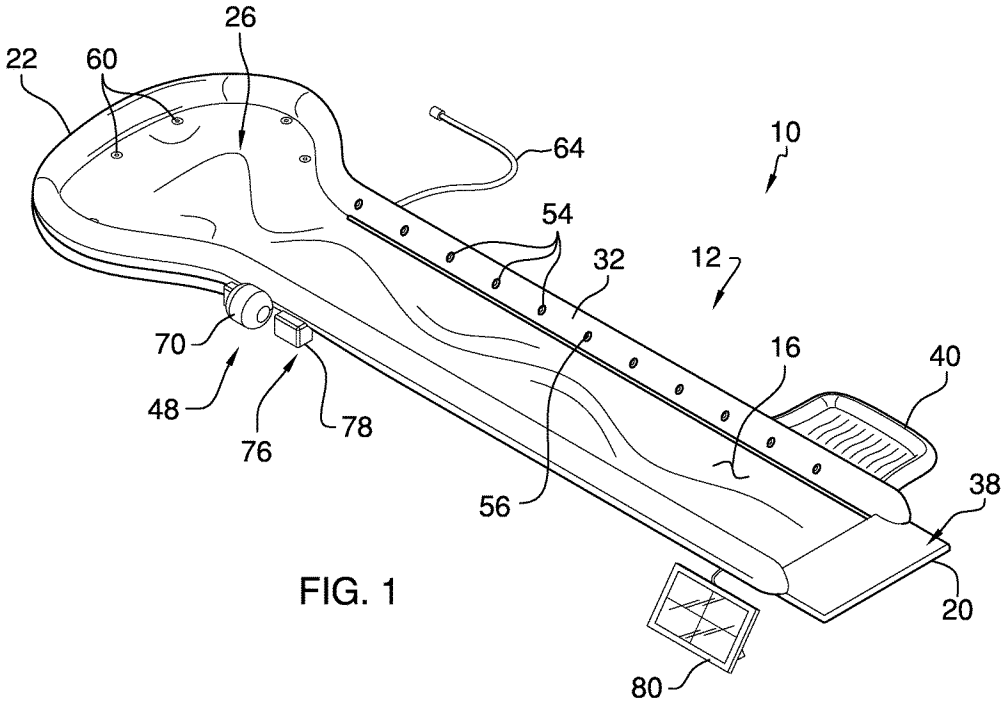
FIG. 1 is a top perspective view of a inflatable water slide assembly according to an embodiment of the disclosure.
Figure 2:
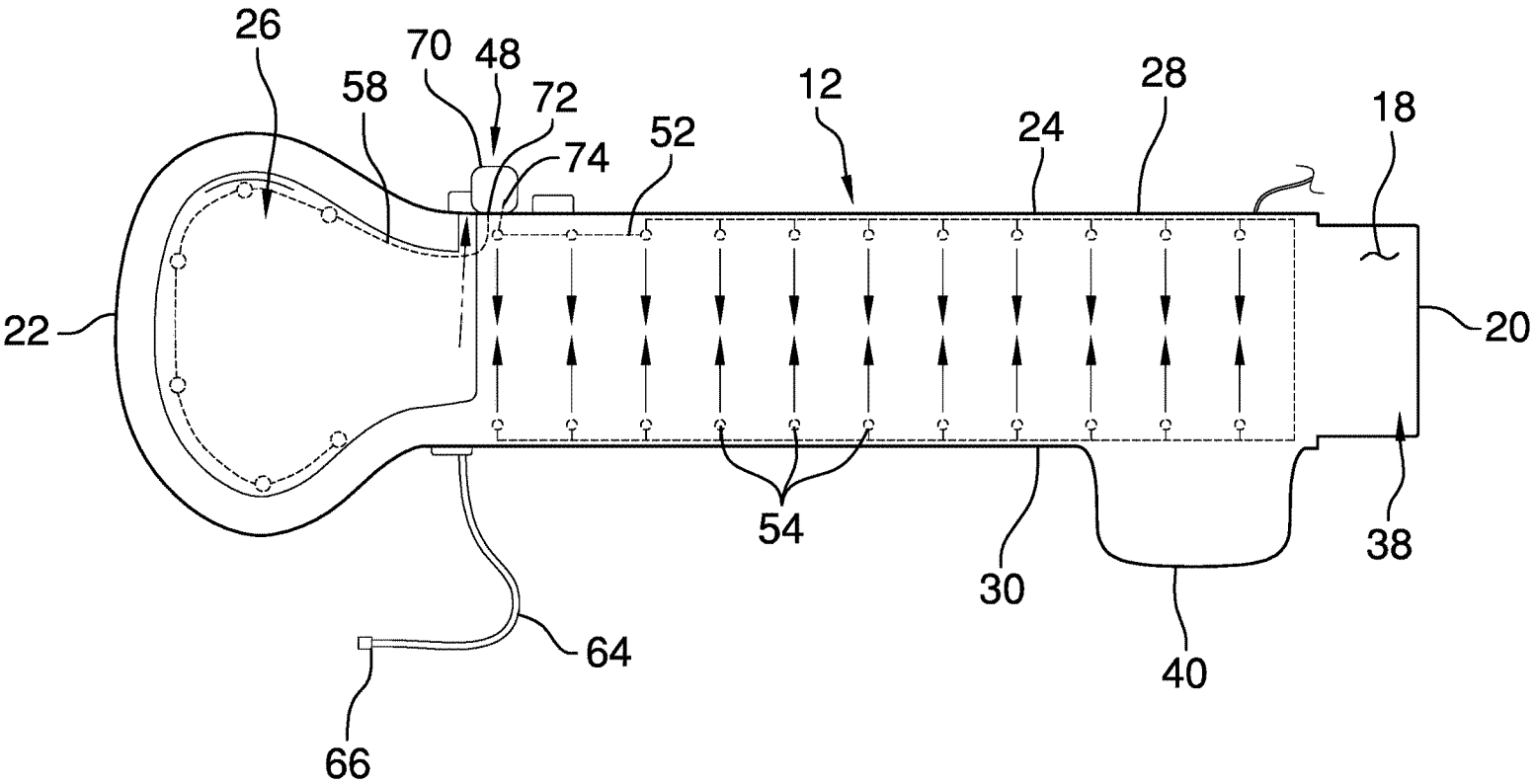
FIG. 2 is a bottom phantom view of an embodiment of the disclosure.
Figure 3:
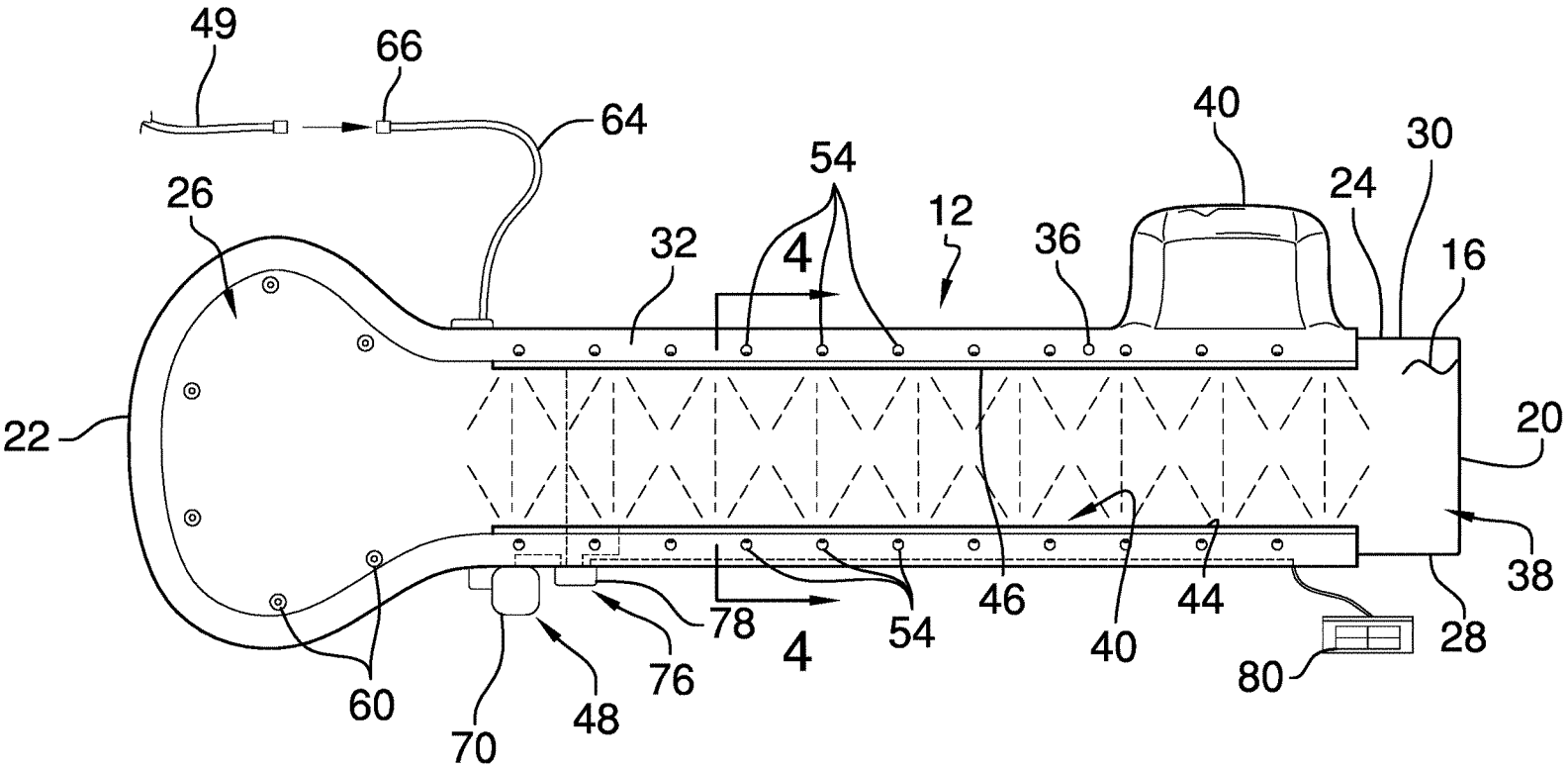
FIG. 3 is a top phantom view of an embodiment of the disclosure.
Figure 4:
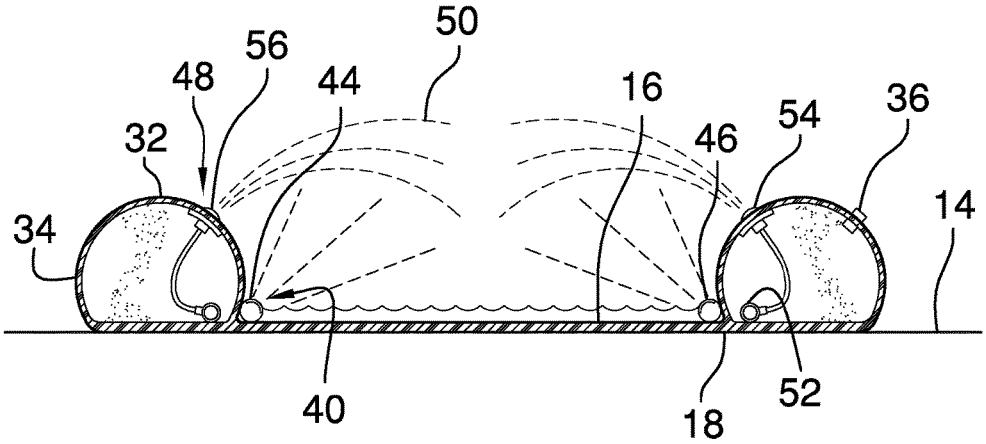
FIG. 4 is a cross sectional view taken along line 4-4 of FIG. 3 of an embodiment of the disclosure.
Figure 5:
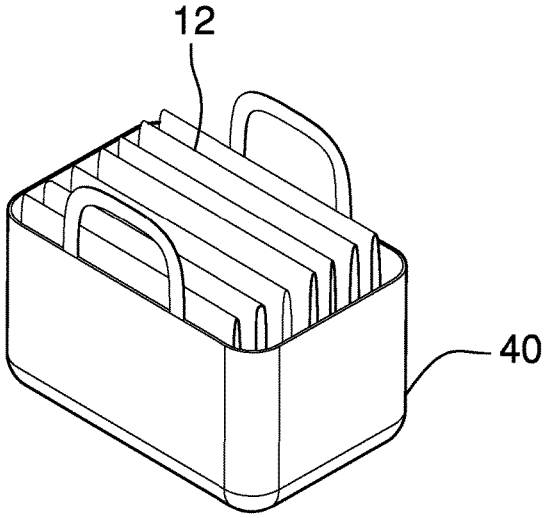
FIG. 5 is a perspective view of a bag of an embodiment of the disclosure.

With reference now to the drawings, and in particular to FIGS. 1 through 5 thereof, a new water slide device embodying the principles and concepts of an embodiment of the disclosure and generally designated by the reference numeral 10 will be described.

As best illustrated in FIGS. 1 through 5, the inflatable water slide assembly 10 generally comprises a slide 12 that may be positioned on a support surface 14 thereby facilitating the slide 12 to be slid upon. The support surface 14 may be ground and people may slide on the slide 12 for recreational purposes. The slide 12 has a top surface 16, a bottom surface 18, a first end 20, a second end 22 and a peripheral edge 24. The peripheral edge 24 is rounded at the second end 22 to define a pool 26 and the peripheral edge 24 has a first lateral side 28 and a second lateral side 30. The slide 12 is comprised of a deformable and fluid impermeable material such as polyvinyl chloride or the like.

A bladder 32 is coupled to the slide 12 and the bladder 32 is selectively inflated. The bladder 32 is attached to the top surface 16 such that an interior of the bladder 32 is fluidly discrete with respect to the slide 12. Moreover, the bladder 32 is coextensive with the first lateral side 28, the second lateral side 30 and the peripheral edge 24 corresponding to the pool 26. The bladder 32 has an outer wall 34 and the bladder 32 is comprised of a deformable and fluid impermeable material such as polyvinyl chloride or the like. Additionally, an inflation valve 36 is coupled to the outer wall 34 of the bladder 32 to selectively inflate and deflate the bladder 32.

The first end 20 of the slide 12 may extend beyond the bladder 32 to define a ramp 38. An auxiliary pool 40 extends outwardly from the bladder 32 corresponding to the second lateral side 30. Additionally, the bladder 32 extends around a perimeter of the auxiliary pool 40 and the auxiliary pool 40 may be positioned closer to the first end 20 of the slide 12 than the second end 22 of the slide 12. A bag 40 may be provided and the slide 12 may be stored in the bag 40 when the slide 12 is not is used.

A lighting unit 42 is provided and the lighting unit 42 is coupled to the slide 12 to selectively illuminate the slide 12. The lighting unit 42 comprises a first light strip 44 that is coupled to the top surface 16 of the slide 12. In this way the first light strip 44 selectively illuminates the top surface 16 when the slide 12 is used during night time. The first light strip 44 is coextensive with the bladder 32 corresponding to the first lateral side 28 of the slide 12.

A second light strip 46 is coupled to the top surface 16 of the slide 12 to illuminate the top surface 16 when the slide 12 is used during night time. The second light strip 46 is coextensive with the bladder 32 corresponding to the second lateral side 30 of the slide 12. Each of the first light strip 44 and the second light strip 46 may comprise an LED light strip or the like. Moreover, each of the first light strip 44 and the second light strip 46 may have light detecting capabilities. In this way each of the first light strip 44 and the second light strip 46 may automatically turn on in a darkened environment.

A spraying unit 48 is provided and the spraying unit 48 is coupled to the slide 12. The spraying unit 48 may be selectively fluidly coupled to a fluid source 49 thereby facilitating the slide 12 to be filled with a fluid 50. The fluid source 49 may be a garden hose 64 or the like and the fluid 50 may be water. The spraying unit 48 continuously recycles the fluid 50. In this way the spraying unit 48 may spray the fluid 50 onto the slide 12 without is continuously fluidly connected to the fluid source 49.

The spraying unit 48 comprises a first conduit 52 that is positioned within the bladder 32. The first conduit 52 is coextensive with the bladder 32 corresponding to each of the first lateral side 28 and the second lateral side 30 of the slide 12. A plurality of first nozzles 54 is provided and each of the first nozzles 54 is coupled to the outer wall 34 of the bladder 32. The first nozzles 54 are spaced apart from each other and are distributed along the bladder 32 corresponding to the first lateral side 28 and the second lateral side 30 of the slide 12. Each of the first nozzles 54 has a distal end 56 with respect to the outer wall 34 and the distal end 56 corresponding to each of the first nozzles 54 is open. Moreover, each of the first nozzles 54 is fluidly coupled to the first conduit 52.

A second conduit 58 is provided and the second conduit 58 is positioned within the bladder 32. The second conduit 58 is coextensive with the peripheral edge 24 corresponding to the pool 26. A plurality of second nozzles 60 is provided and each of the second nozzles 60 is coupled to the top surface 16 of the slide 12 corresponding to the pool 26. Each of the second nozzles 60 is fluidly coupled to the second conduit 58 and each of the second nozzles 60 has a distal end 62 with respect to the top surface 16. The distal end 62 corresponding to each of the second nozzles 60 is open.

A hose 64 is coupled to the slide 12 and the hose 64 has a distal end 66 with respect to the slide 12. The distal end 66 of the hose 64 is selectively fluidly coupled to a fluid source 49. The hose 64 is in fluid 50 communication with the pool 26 to fill the pool 26 with the fluid 50. The hose 64 is selectively disconnected from the fluid source 49 when the pool 26 is filled with the fluid 50.

A pump 70 is provided and the pump 70 is coupled to the pool 26. The pump 70 has an intake 72 and an outlet 74. The intake 72 is fluidly coupled to the second conduit 58 to draw the fluid 50 through each of the second nozzles 60 and into the intake 72. The outlet 74 is fluidly coupled to the first conduit 52 to urge the fluid 50 outwardly through each of the first nozzles 54 and onto the top surface 16 of the slide 12. The pump 70 may be an electric water pump or the like and the pump 70 may have an on/off switch.

A power supply 76 is coupled to the slide 12 and the power supply 76 is electrically coupled to the pump 70. The power supply 76 comprises at least one battery 78 that is coupled to the slide 12. The at least one battery 78 is electrically coupled to the pump 70. A plurality of solar cells 80 is provided and each of the solar cells 80 is coupled to the slide 12 to be exposed to sunlight. Each of the solar cells 80 is electrically coupled to the at least one battery 78 such that each of the solar cells 80 charges the battery 78.

In use, the slide 12 is laid on the support surface 14 and the bladder 32 is inflated. The hose 64 is fluidly coupled to the fluid source 49 to fill the pool 26 with the fluid 50. The hose 64 is selectively disconnected from the fluid source 49 when the pool 26 is filled with the fluid 50. In this way the fluid 50 is conserved with respect to continuously supplying fluid 50 to the slide 12. The pump 70 is turned on to draw the fluid 50 inwardly through the second nozzles 60 and outwardly through the first nozzles 54. Each of the first nozzles 54 sprays the fluid 50 onto the top surface 16 of the slide 12 thereby reducing friction between the top surface 16 and individuals sliding on the slide 12. The hose 64 is selectively fluidly connected to the fluid source 49 to re-fill the pool 26 when the fluid 50 in the pool 26 is depleted.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. An inflatable water slide assembly being configured to be employed without being continuously fluidly connected to a fluid source, said assembly comprising:

a slide being configured to be positioned on a support surface thereby facilitating said slide to be slid upon, said slide having a top surface, a bottom surface, a first end, a second end and a peripheral edge, said peripheral edge being rounded at said second end to define a pool, said peripheral edge having a first lateral side and a second lateral side;

a bladder being coupled to said slide;

a lighting unit being coupled to said slide wherein said lighting unit is configured to selectively illuminate said slide; and a spraying unit being coupled to said slide, said spraying unit being configured to be selectively fluidly coupled to a fluid source thereby facilitating said slide to be filled with a fluid, said spraying unit continuously recycling the fluid wherein said spraying unit is configured to spray the fluid onto said slide without being fluidly connected to the fluid source;

a pump coupled to said slide, said pump being positioned proximate said pool; and a plurality of solar cells, each of said solar cells being coupled to a panel, said panel being coupled to said pump by a cord extending from said pump, passing through said slide, and extending out from said slide proximate said first end wherein each of said solar cells is configured to be exposed to sunlight.

2. The assembly according to claim 1, wherein said bladder is attached to said top surface such that an interior of said bladder is fluidly discrete with respect to said slide, said bladder being coextensive with said first lateral side, said second lateral side and said peripheral edge corresponding to said pool, said bladder having an outer wall.

3. The assembly according to claim 2, wherein said lighting unit comprises a first light strip being coupled to said top surface of said slide wherein said first light strip is configured to illuminate said top surface, said first light strip being coextensive with said bladder corresponding to said first lateral side of said slide.

4. The assembly according to claim 3, further comprising a second light strip being coupled to said top surface of said slide wherein said second light strip is configured to illuminate said top surface, said second light strip being coextensive with said bladder corresponding to said second lateral side of said slide.

5. The assembly according to claim 2, wherein said spraying unit comprises a first conduit being positioned within said bladder, said first conduit being coextensive with said bladder corresponding to each of said first lateral side and said second lateral side of said slide.

6. The assembly according to claim 5, further comprising a plurality of first nozzles, each of said first nozzles being coupled to said outer wall of said bladder, said plurality of first nozzles being spaced apart from each other and being distributed along said bladder corresponding to said first lateral side and said second lateral side of said slide, each of said first nozzles having a distal end with respect to said outer wall, said distal end corresponding to each of said first nozzles being open, each of said first nozzles being fluidly coupled to said first conduit.

7. The assembly according to claim 6, further comprising a second conduit being positioned within said bladder, said second conduit being coextensive with said peripheral edge corresponding to said pool.

8. The assembly according to claim 7, further comprising a plurality of second nozzles, each of said second nozzles being coupled to said top surface of said slide corresponding to said pool, each of said second nozzles being fluidly coupled to said second conduit, each of said second nozzles having a distal end with respect to said top surface, said distal end corresponding to each of said second nozzles being open.

9. The assembly according to claim 8, further comprising said pump having an intake and an outlet, said intake being fluidly coupled to said second conduit wherein said pump is configured to draw the fluid through each of said second nozzles and into said intake, said outlet being fluidly coupled to said first conduit wherein said pump is configured to urge the fluid outwardly through each of said first nozzles and onto said top surface of said slide.

10. The assembly according to claim 1, further comprising a hose being coupled to said slide, said hose having a distal end with respect to said slide, said distal end of said hose being configured to be fluidly coupled to a fluid source, said hose being in fluid communication with said pool wherein said hose is configured to fill said pool with a fluid.

11. An inflatable water slide assembly being configured to be employed without being continuously fluidly connected to a fluid source, said assembly comprising:

a slide being configured to be positioned on a support surface thereby facilitating said slide to be slid upon, said slide having a top surface, a bottom surface, a first end, a second end and a peripheral edge, said peripheral edge being rounded at said second end to define a pool, said peripheral edge having a first lateral side and a second lateral side;

a bladder being coupled to said slide, said bladder being attached to said top surface such that an interior of said bladder is fluidly discrete with respect to said slide, said bladder being coextensive with said first lateral side, said second lateral side and said peripheral edge corresponding to said pool, said bladder having an outer wall;

a lighting unit being coupled to said slide wherein said lighting unit is configured to selectively illuminate said slide, said lighting unit comprising:

a first light strip being coupled to said top surface of said slide wherein said first light strip is configured to illuminate said top surface, said first light strip being coextensive with said bladder corresponding to said first lateral side of said slide, and a second light strip being coupled to said top surface of said slide wherein said second light strip is configured to illuminate said top surface, said second light strip being coextensive with said bladder corresponding to said second lateral side of said slide; and a spraying unit being coupled to said slide, said spraying unit being configured to be selectively fluidly coupled to a fluid source thereby facilitating said slide to be filled with a fluid, said spraying unit continuously recycling the fluid wherein said spraying unit is configured to spray the fluid onto said slide without being fluidly connected to the fluid source, said spraying unit comprising:

a first conduit being positioned within said bladder, said first conduit being coextensive with said bladder corresponding to each of said first lateral side and said second lateral side of said slide, a plurality of first nozzles, each of said first nozzles being coupled to said outer wall of said bladder, said plurality of first nozzles being spaced apart from each other and being distributed along said bladder corresponding to said first lateral side and said second lateral side of said slide, each of said first nozzles having a distal end with respect to said outer wall, said distal end corresponding to each of said first nozzles being open, each of said first nozzles being fluidly coupled to said first conduit, a second conduit being positioned within said bladder, said second conduit being coextensive with said peripheral edge corresponding to said pool, a plurality of second nozzles, each of said second nozzles being coupled to said top surface of said slide corresponding to said pool, each of said second nozzles being fluidly coupled to said second conduit, each of said second nozzles having a distal end with respect to said top surface, said distal end corresponding to each of said second nozzles being open, a hose being coupled to said slide, said hose having a distal end with respect to said slide, said distal end of said hose being configured to be fluidly coupled to a fluid source, said hose being in fluid communication with said pool wherein said hose is configured to fill said pool with a fluid, a pump being coupled to said slide, said pump being positioned proximate said pool, said pump having an intake and an outlet, said intake being fluidly coupled to said second conduit wherein said pump is configured to draw the fluid through each of said second nozzles and into said intake, said outlet being fluidly coupled to said first conduit wherein said pump is configured to urge the fluid outwardly through each of said first nozzles and onto said top surface of said slide, and a power supply being coupled to said slide, said power supply being electrically coupled to said pump, said first light strip and said second light strip, said power supply comprising:

at least one battery being coupled to said slide, said at least one battery being electrically coupled to said pump, and a plurality of solar cells, each of said solar cells being coupled to a panel, said panel being coupled to said pump by a cord extending from said pump, passing through said slide, and extending out from said slide proximate said first end wherein each of said solar cells is configured to be exposed to sunlight, each of said solar cells being electrically coupled to said at least one battery such that each of said solar cells charges said battery.

* * * * *